US006243974B1

(12) United States Patent
Schaj

(10) Patent No.: US 6,243,974 B1
(45) Date of Patent: Jun. 12, 2001

(54) SANDAL HAVING COMPARTMENTS THEREIN

(76) Inventor: Patrick N. Schaj, 2003 Old Falcon Bridge Highway, Garson, Ontario (CA), P3L 1M4

( * ) Notice: Subject to any disclaimer, the term of this patent is extended or adjusted under 35 U.S.C. 154(b) by 0 days.

(21) Appl. No.: 09/602,112

(22) Filed: Jun. 23, 2000

(51) Int. Cl.[7] ..... A43B 23/00
(52) U.S. Cl. ..... 36/136; 36/11.5
(58) Field of Search ..... 36/11.5, 136–132

(56) References Cited

U.S. PATENT DOCUMENTS

| | | | | |
|---|---|---|---|---|
| D. 278,092 | | 3/1985 | Gamm . | |
| 2,205,091 | * | 6/1940 | Geffner | 36/11.5 |
| 2,478,411 | | 8/1949 | Martin . | |
| 2,507,991 | * | 5/1950 | Neal | 36/136 |
| 2,599,740 | * | 6/1952 | Beveridge | 36/11.5 |
| 2,897,609 | | 8/1959 | Bodkin . | |
| 3,018,570 | | 1/1962 | Bliese . | |
| 3,325,918 | * | 6/1967 | Weitzner | 36/136 |
| 4,124,946 | * | 11/1978 | Tomlin | 36/11.5 |
| 4,471,539 | | 9/1984 | Mann . | |
| 4,686,781 | | 8/1987 | Bury . | |
| 5,921,008 | * | 7/1999 | Ruff | 36/136 |
| 6,094,844 | * | 8/2000 | Potts | 36/136 |

* cited by examiner

*Primary Examiner*—M. D. Patterson

(57) ABSTRACT

A sandal having compartments therein for storing relatively small items within the shoes of the user. The sandal having compartments therein includes a bottom sole portion and a top sole portion which are securely attached together. A strap means releasably secures a foot to the top sole portion and is securely coupled to a top surface of the bottom sole portion. Each of a plurality of compartments includes a well extending into a side of the top sole portion and a container. The container has a cavity therein. The container has a front wall, a back wall, a top wall, a bottom wall, and a pair of side walls. The front wall has an elongate slit therein for access to the cavity. The container is positioned within the well such that the front wall faces outwardly of the well. A plurality of compartments are disposed within the top sole portion.

4 Claims, 2 Drawing Sheets

FIG.3
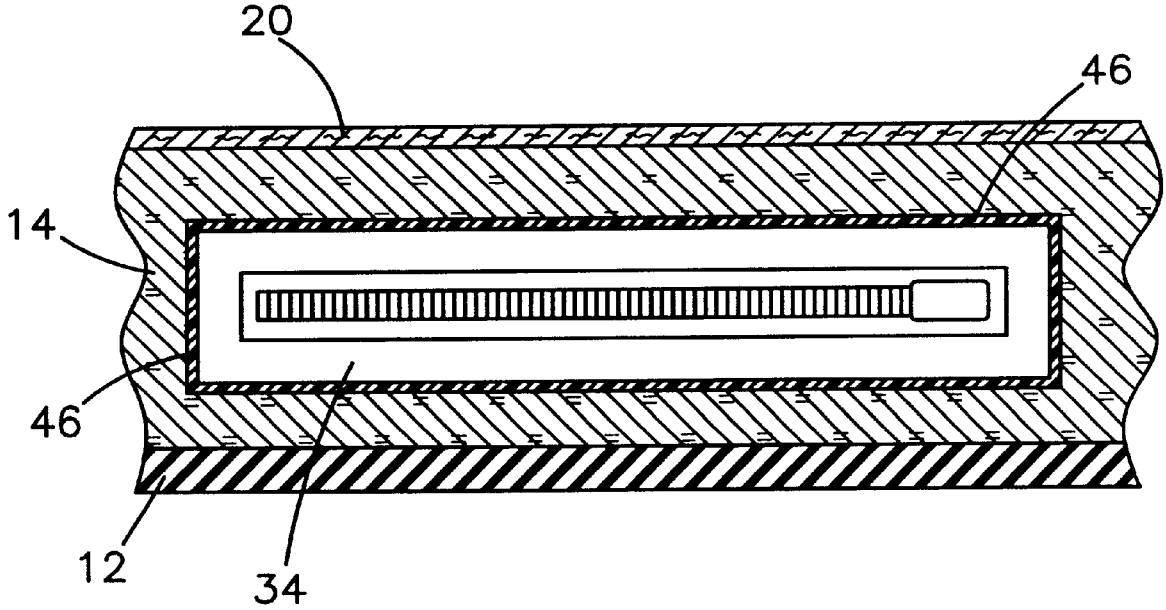
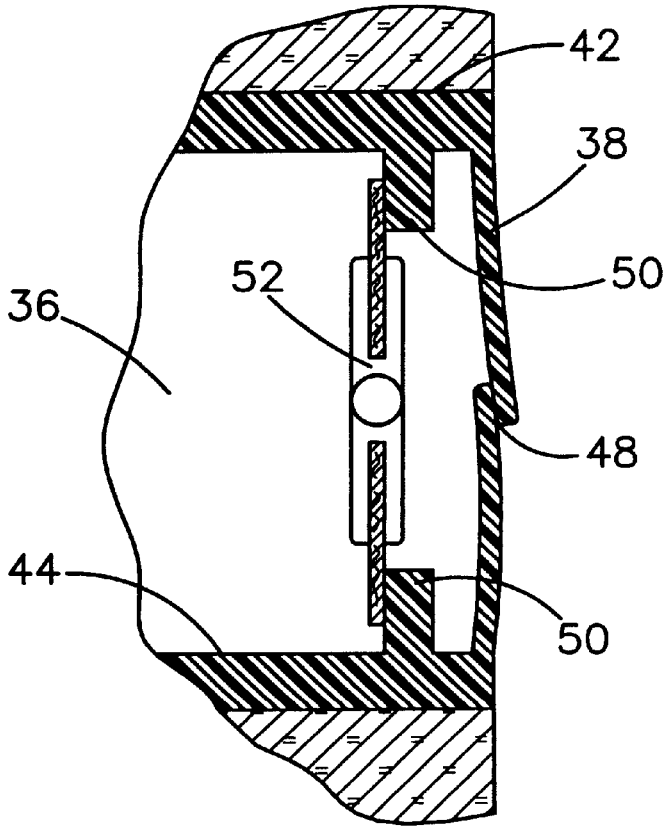
FIG.4

SANDAL HAVING COMPARTMENTS THEREIN

BACKGROUND OF THE INVENTION

1. Field of the Invention

The present invention relates to shoes and more particularly pertains to a new sandal having compartments therein for storing relatively small items within the shoes of the user.

2. Description of the Prior Art

The use of shoes is known in the prior art. More specifically, shoes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,478,411; 4,471,539; 3,018,570; 4,686,781; 2,897,609; and U.S. Pat. No. Des. 278,092.

While these devices fulfill their respective, particular objectives and requirements, the aforementioned patents do not disclose a new sandal having compartments therein. The inventive device includes a bottom sole portion and a top sole portion which are securely attached together. A strap means releasably secures a foot to the top sole portion and is securely coupled to a top surface of the top sole portion. Each of a plurality of compartments includes a well extending into a side of the top sole portion and a container. The container has a lumen therein. The container has a front wall, a back wall, a top wall, a bottom wall, and a pair of side walls. The front wall has an elongate slit therein for access to the lumen. The container is positioned within the well such that the front wall faces outwardly of the well. A plurality of compartments are disposed within the top sole portion.

In these respects, the sandal having compartments therein according to the present invention substantially departs from the conventional concepts and designs of the prior art, and in so doing provides an apparatus primarily developed for the purpose of storing relatively small items within the shoes of the user.

SUMMARY OF THE INVENTION

In view of the foregoing disadvantages inherent in the known types of shoes now present in the prior art, the present invention provides a new sandal having compartments therein construction wherein the same can be utilized for storing relatively small items within the shoes of the user.

The general purpose of the present invention, which will be described subsequently in greater detail, is to provide a new sandal having compartments therein apparatus and method which has many of the advantages of the shoes mentioned heretofore and many novel features that result in a new sandal having compartments therein which is not anticipated, rendered obvious, suggested, or even implied by any of the prior art shoes, either alone or in any combination thereof.

To attain this, the present invention generally comprises a bottom sole portion and a top sole portion which are securely attached together. A strap means releasably secures a foot to the top sole portion and is securely coupled to a top surface of the top sole portion. Each of a plurality of compartments includes a well extending into a side of the top sole portion and a container. The container has a lumen therein. The container has a front wall, a back wall, a top wall, a bottom wall, and a pair of side walls. The front wall has an elongate slit therein for access to the lumen. The container is positioned within the well such that the front wall faces outwardly of the well. A plurality of compartments are disposed within the top sole portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sandal having compartments therein apparatus and method which has many of the advantages of the shoes mentioned heretofore and many novel features that result in a new sandal having compartments therein which is not anticipated, rendered obvious, suggested, or even implied by any of the prior art shoes, either alone or in any combination thereof.

It is another object of the present invention to provide a new sandal having compartments therein which may be easily and efficiently manufactured and marketed.

It is a further object of the present invention to provide a new sandal having compartments therein which is of a durable and reliable construction.

An even further object of the present invention is to provide a new sandal having compartments therein which is susceptible of a low cost of manufacture with regard to both materials and labor, and which accordingly is then susceptible of low prices of sale to the consuming public, thereby making such sandal having compartments therein economically available to the buying public.

Still yet another object of the present invention is to provide a new sandal having compartments therein which provides in the apparatuses and methods of the prior art some of the advantages thereof, while simultaneously overcoming some of the disadvantages normally associated therewith.

Still another object of the present invention is to provide a new sandal having compartments therein for storing relatively small items within the shoes of the user.

Yet another object of the present invention is to provide a new sandal having compartments therein which includes a bottom sole portion and a top sole portion which are securely attached together. A strap means releasably secures a foot to the top sole portion and is securely coupled to a top surface of the top sole portion. Each of a plurality of compartments includes a well extending into a side of the top sole portion and a container. The container has a lumen therein. The container has a front wall, a back wall, a top wall, a bottom wall, and a pair of side walls. The front wall has an elongate slit therein for access to the lumen. The container is positioned within the well such that the front wall faces outwardly of the well. A plurality of compartments are disposed within the top sole portion.

Still yet another object of the present invention is to provide a new sandal having compartments therein that have a closing means therein for resisting loss of items contained therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic cross-sectional view taken along line 3—3 of the present invention.

FIG. 4 is a schematic cross-sectional view taken along line 4—4 of the present invention.

DESCRIPTION OF THE PREFERRED EMBODIMENT

Figure 1:
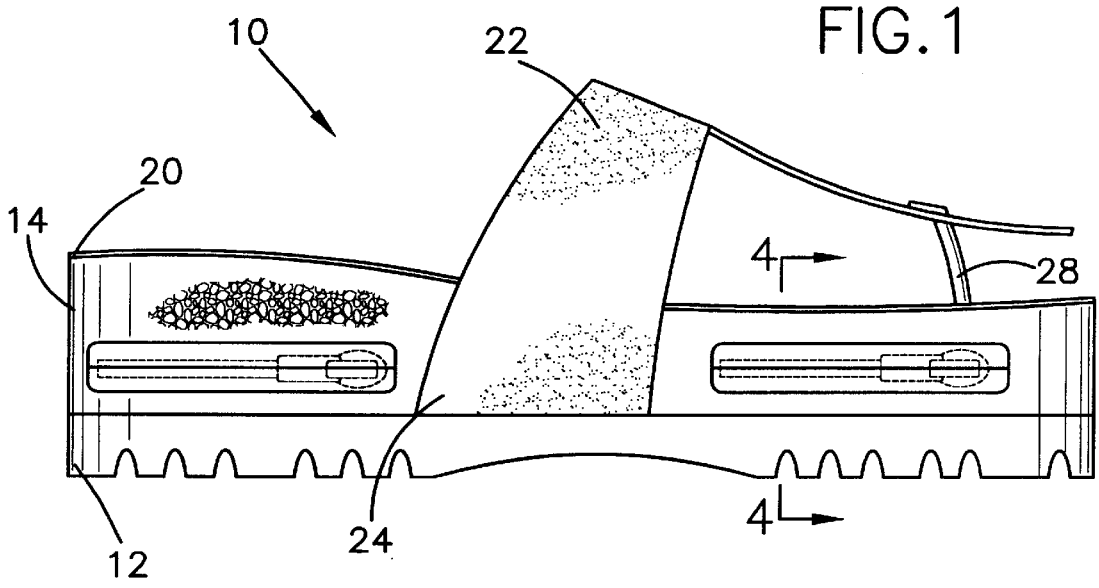
FIG. 1 is a schematic side view of a new sandal having compartments therein according to the present invention.
Figure 2:
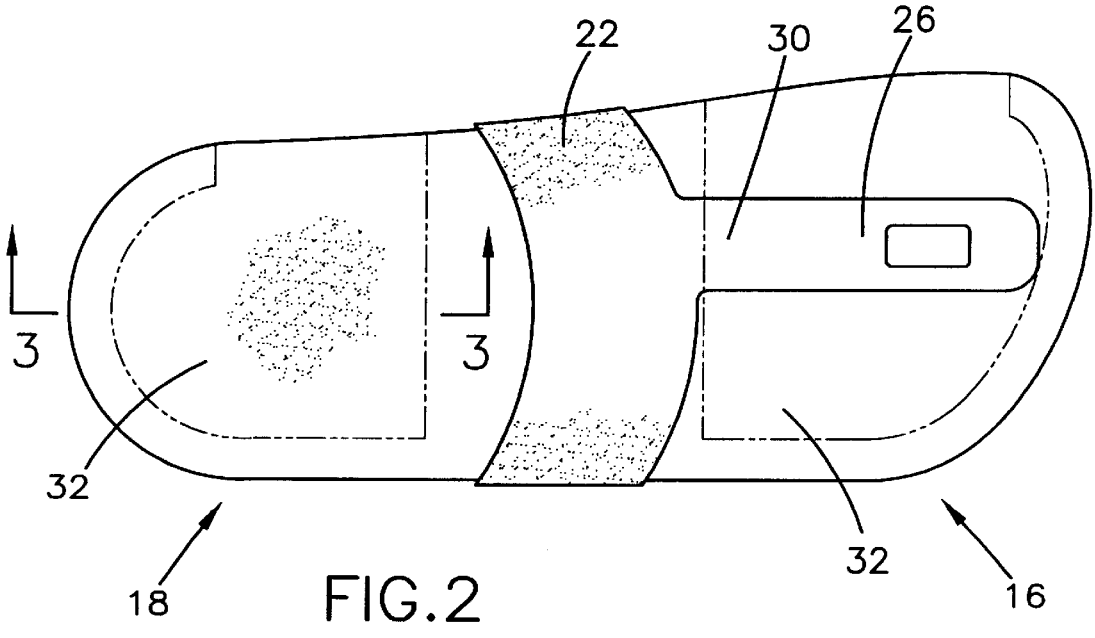
FIG. 2 is a schematic plan view of the present invention.

With reference now to the drawings, and in particular to FIGS. 1 through 4 thereof, a new sandal having compartments therein embodying the principles and concepts of the present invention and generally designated by the reference numeral 10 will be described.

As best illustrated in FIGS. 1 through 4, the sandal having compartments therein 10 generally comprises a bottom sole portion 12 and a top sole portion 14 securely attached together. The bottom sole portion 12 preferably comprises an elastomeric material, and the top sole portion 14 preferably comprises a cork material. Each of the sole portions 12, 14 has a front half 16 and a back half 18.

A panel 20 substantially covers and is securely attached to a top surface of the top sole portion 14. The panel 20 preferably comprises a cloth material and may also comprise a leather material.

A strap means 22 releasably secures a foot to the top sole portion. The strap means 22 has a pair of ends 24. Each of the ends 24 is coupled to an opposite side of the top sole portion 14 such that the strap means 22 transverses a longitudinal axis of the top sole portion. The strap means 22 is generally positioned between the front 16 and back 18 halves.

A toe engaging member 26 has a first end 28 coupled to the top surface of the top sole portion 14. The toe engaging member 26 is positioned in the front half 16. A second end 30 of the toe engaging member is securely coupled to the strap means 22.

Each of a plurality of compartments comprises a well 32 and a container 34. The well 32 extends into a side of the top sole portion 14. The container has a cavity 36 therein. The container 34 has a front wall 38, a back wall, not shown, a top wall 42, a bottom wall 44, and a pair of side walls 46. The front wall 38 has an elongate slit 48 therein for access to the cavity 36. The container 34 is positioned within the well 32 such that the front wall 38 faces outwardly of the well 32. The container 34 preferably comprises a plastic material.

A closing means for selectively closing the container includes a pair of opposed flanges 50 extending between the side walls 46 of the container. Each of the flanges 50 is integral to one of the top 42 and bottom 44 walls such that the flanges 50 extend toward each other. The flanges 50 are positioned generally adjacent to the front wall 38. A zipper means 52 closes an opening between the flanges 50 and attached to the flanges.

Preferably there are two compartments. A first of the compartments is in the front half 16 of the top sole portion, and a second of the compartments is in the back half 18 of the top sole portion.

In use, the sandal is worn like a conventional sandal. The slit 48 allows access the containers 34 held within the wells 32. The zipper means 52 allows a user to close the container so that items placed therein do not fall out through the slit 48.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sandal having a plurality of compartments therein, said sandal comprising:

a bottom sole portion and a top sole portion being securely attached together;

a strap means for releasably securing a foot to said top sole portion, said strap means being securely coupled to a top surface of said bottom sole portion;

a plurality of compartments, each of said compartments comprising:

a well, said well extending into a side of said top sole portion;

a container, said container having a cavity therein, said container having a front wall, a back wall, a top wall, a bottom wall, and a pair of side walls, said front wall having an elongate slit therein for access to said cavity, said container being positioned within said well such that said front wall faces outwardly of said well;

said plurality of compartments being disposed within said top sole portion; and a closing means for selectively closing said container, said closing means comprising a pair of opposed flanges extending between said side walls of said container, each of said flanges being integral to one of said top and bottom walls such that said flanges extend toward each other, said flanges being positioned generally adjacent to said front wall, a zipper means for closing an opening between said flanges being attached to said flanges.

2. The sandal as in claim 1, wherein said container further comprises a plastic material.

3. A sandal having a plurality of compartments therein, said sandal comprising:

a bottom sole portion and a top sole portion being securely attached together, said bottom sole portion comprising an elastomeric material, said top sole portion comprising a cork material, each of said sole portions having a front half and a back half;

a panel, said panel substantially covering and being securely attached to a top surface of said top sole portion, said panel comprising a cloth material;

a strap means for releasably securing a foot to said top sole portion, said strap means having a pair of ends, each of said ends being coupled to an opposite side of said top sole portion such that said strap means transverses a longitudinal axis of said top sole portion, said strap means being generally positioned between said front and back halves;

a toe engaging member, said toe engaging member having a first end coupled to said top surface of said top sole portion, said toe engaging member being positioned in said front half, a second end of said toe engaging member being securely coupled to said strap means;

a plurality of compartments, each of said compartments comprising:

a well, said well extending into a side of said top sole portion;

a container, said container having a cavity therein, said container having a front wall, a back wall, a top wall, a bottom wall, and a pair of side walls, said front wall having an elongate slit therein for access to said cavity, said container being positioned within said well such that said front wall faces outwardly of said well, said container comprising a plastic material;

a closing means for selectively closing said container, said closing means comprising a pair of opposed flanges extending between said side walls of said container, each of said flanges being integral to one of said top and bottom walls such that said flanges extend toward each other, said flanges being positioned generally adjacent to said front wall, a zipper means for closing an opening between said flanges being attached to said flanges; and wherein there are two compartments, a first of said compartments being in said front half of said top sole portion and a second of said compartments being in said back half of said top sole portion.

4. A sandal having a plurality of compartments therein, said sandal comprising:

a bottom sole portion and a top sole portion being securely attached together;

a strap means for releasably securing a foot to said top sole portion, said strap means being securely coupled to said bottom sole portion;

a plurality of compartments, each of said compartments comprising:

a well extending into a side of said top sole portion;

a container having a cavity therein, said container having a front wall, a back wall, a top wall, a bottom wall, and a pair of side walls, said front wall having an elongate slit therein for access to said cavity, said container being positioned in said well such that said front wall faces outwardly of said well; and a closing means for selectively closing said container, said closing means comprising a pair of opposed flanges extending between said side walls of said container, each of said flanges being integral to one of said top and bottom walls such that said flanges extend toward each other, said flanges being positioned generally adjacent to said front wall, a zipper means for closing an opening between said flanges being attached to said flanges.

* * * * *